US012209785B2

(12) United States Patent
Ferrara et al.

(10) Patent No.: US 12,209,785 B2
(45) **Date of Patent: *Jan. 28, 2025**

(54) PNEUMATICALLY ACTUATED CRYOCOOLER

(71) Applicant: The United States of America, as represented by the Secretary of the Navy, Arlington, VA (US)

(72) Inventors: Peter J. Ferrara, Westampton, NJ (US); Jacob T. Kephart, Garnet Valley, PA (US); Avi Friedman, Bethesda, MD (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/415,721

(22) Filed: Jan. 18, 2024

(65) Prior Publication Data

US 2024/0255191 A1 Aug. 1, 2024

Related U.S. Application Data

(63) Continuation of application No. 16/946,592, filed on Jun. 29, 2020, now Pat. No. 11,913,697.

(51) Int. Cl.
*F25B 9/14* (2006.01)

(52) U.S. Cl.
CPC ..... *F25B 9/14* (2013.01); *F25B 2309/003* (2013.01); *F25B 2309/14* (2013.01)

(58) Field of Classification Search
CPC ..... F25B 9/14; F25B 2309/003
USPC ..... 62/55.5
See application file for complete search history.

(56) References Cited

U.S. PATENT DOCUMENTS

| | | | |
|---|---|---|---|
| 2,906,101 | A | 9/1959 | McMahon et al. |
| 3,119,237 | A | 1/1964 | Gifford |
| 3,620,029 | A | 11/1971 | Longsworth |
| 6,038,866 | A | 3/2000 | Okamoto et al. |
| 6,256,997 | B1 | 7/2001 | Longsworth |
| 6,335,426 | B1 | 1/2002 | Shanafelt et al. |
| 6,532,748 | B1 | 3/2003 | Yuan et al. |
| 6,560,969 | B1 | 5/2003 | Eckels |
| 2004/0045315 | A1 | 3/2004 | Kamoshita et al. |
| 2012/0085121 | A1 | 4/2012 | Longsworth |
| 2015/0192116 | A1 | 7/2015 | Haug et al. |

OTHER PUBLICATIONS

Wang, Brown, and Friebel: A Compact Cold Helium Circulation System with GM Cryocooler; Cryocoolers 18, 545-550 (2014); International Cryocooler Conference, Inc., Boulder CO, US.

Johnson, Smedley, Mon, Ross, and NARVAEZ: Cryocooler Electromagnetic Compatibility; Cryocoolers 8, pp. 209-220 (1995), Plenum Publishers, New York, US.

*Primary Examiner* — Nael N Babaa

(74) *Attorney, Agent, or Firm* — Naval Surface Warfare Center, Philadelphia Division; Mark J. Rosen

(57) ABSTRACT

A pneumatic cryocooler using a pneumatic motor for use in cryogenically cooling superconductors, which pneumatic cryocooler is capable of operation in strong magnetic fields.

14 Claims, 2 Drawing Sheets

PNEUMATICALLY ACTUATED CRYOCOOLER

STATEMENT OF GOVERNMENT INTEREST

The invention described herein may be manufactured and used by or for the Government of the United States of America for governmental purposes without payment of any royalties thereon or therefor.

FIELD OF THE INVENTION

The invention is related to the field of superconductors and cryogenic cooling devices, or cryocoolers, capable of operating in the presence of large magnetic fields and without certain other disadvantages present in the art.

BACKGROUND OF THE INVENTION

Superconductors have the ability to conduct electricity with essentially zero resistance when kept below a cryogenic transition temperature. This allows superconducting wire to carry much larger current densities than traditional conductors. Such superconducting wire can be used to construct superconducting magnets, useful in a variety of technologies, from MRI machines to particle accelerators. The large current density carried in such superconducting wires, however, causes superconducting magnets to create strong magnetic fields, frequently in excess of 1 Tesla (T).

Superconductors operate at extreme cold temperatures. Generally, the colder the temperature, the more current flows in the superconductor. Different applications for superconductors require differing quantities of current flow, and thus the temperatures required to achieve the desired current flow concomitantly vary. Cryogenic cooling for superconductors is conventionally accomplished through the use of a variety of different cryogenic cooler mechanisms known to those of skill in the art, referred to herein as cyrocoolers. Cryocoolers using the Gifford-McMahon (GM) cycle, for example, generally can attain cryogenic temperatures below 120K and as low as 12K. Gifford and McMahon described the basic operation of the GM cryocooler in U.S. Pat. No. 2,906,101. Gifford described certain improved methods in U.S. Pat. No. 3,119,237.

GM cryocoolers typically use a rotary valve which cyclically modulates the pressure in the cryocooler's chamber between high and low pressure states. When gas is introduced into the chamber at high pressure and the pressure is thereafter reduced, the gas expands, the heat of expansion is drawn away, and the cold end of the cryocooler is cooled.

Current GM cryocoolers use electrical motors to actuate the rotary valve in the cryocooler's pneumatically driven expander/regenerator, but such electrical motors are highly susceptible to degraded performance, or even complete failure, when operation is attempted in the presence of a large magnetic field, such as near a superconducting magnet. Accordingly, such cryocoolers must be positioned sufficiently distant from the magnetic field of such superconductor magnets in order to allow for their operation. Where space constraints limit the positioning of the cryocooler, however, there may not be sufficient distance to place the cryocooler outside the strong magnetic field of the superconducting magnet. For example, in Naval vessels or aircraft, the space available is frequently extremely limited, and locating such cryocoolers outside the magnetic field is simply not possible.

In one attempt to avert this problem, those of skill in the art will appreciate that one may separate the electric motor from the cryocooler, locating just that motor portion of the cryocooler outside the magnetic field produced by the superconducting magnets. The remote motor could then be connected via a variety of mechanical linkage means, such as cams, gears, sprockets, belts, chains, and flexible shafts. The cryocooler would remain near the superconducting magnets, but the remote motor remains outside the strongest magnetic fields.

However, such a solution brings certain disadvantages as well. The mechanical connections, lengthy shafts, and/or additional fittings and parts required to connect the remote motor to the cryocooler over a sufficient distance decrease reliability and efficiency, and increase the costs and efforts of routine maintenance. Additionally, even at a distance the motor will still be exposed to the magnetic field of the superconducting magnet, reducing its functionality.

The art is in need of improved ways to cryogenically cool superconductors having strong magnetic fields without the disadvantages of current designs.

SUMMARY OF THE INVENTION

Having observed the aforementioned problems with conventional cryogenic cooling devices, the inventors herein provide solutions.

In one solution, the invention provides a novel cryogenic cooler which relies on a pneumatic motor rather than an electrical motor to drive the rotary valve. Pneumatic motors do not suffer the disadvantages of electric motors when operated in strong magnetic fields. This design allows such cryogenic coolers to be located in close proximity to the superconducting magnets without the magnetic fields produced thereby reducing the performance of the cryocooler. The closer the cryocooler is placed to the superconducting magnets, the less energy is lost in cooling, thereby improving the overall efficiency and reliability of the system. Additionally, pneumatic motors do not need a separate power supply as are required by electric motors, thus no additional power components are needed.

The current invention uses a pneumatic motor to activate the rotary valve of a GM cryocooler which controls the connections to high and low pressure fluid which enter and exit the cryocooler's displacer/expander.

In one aspect, the invention is directed to a pneumatic cryocooler having a cryocooler assembly with a first end and a second end, the first end having a rotary valve, a plurality of ports for a cryogenic fluid, and a motor mount; the second end having a heat exchanger; and a pneumatic motor assembly with a pneumatic motor operably connected to the motor mount on the first end of the cryocooler assembly. In one aspect, the cryocooler assembly is a GM cryocooler assembly. In some aspects, the GM cryocooler assembly has a base tube and a displacer tube, the displacer tube having within a displacer and a regenerator. In some aspects, the plurality of ports carrying cryogenic fluid supplies the cryocooler assembly with the cryogenic fluid. In other aspects the plurality of ports carrying cryogenic fluid also supplies the pneumatic motor with the same cryogenic fluid. In some aspects, helium is both the cryogenic and the pneumatic fluid. In other aspects, the plurality of ports provide separate ports for a cryogenic fluid and a different pneumatic fluid. The pneumatic fluid may be air, hydraulic fluid, helium, and other suitable pneumatic fluids. The pneumatic cryocooler of the invention is capable of operation in a strong magnetic field. In some aspects, the invention provides methods of cryogenically cooling a variety of devices, such as superconducting magnets and others, by applying the heat exchanger to such devices.

These and other aspects of the invention will be readily appreciated by those of skill in the art from the description of the invention herein.

DETAILED DESCRIPTION OF THE INVENTION

Figure 1:
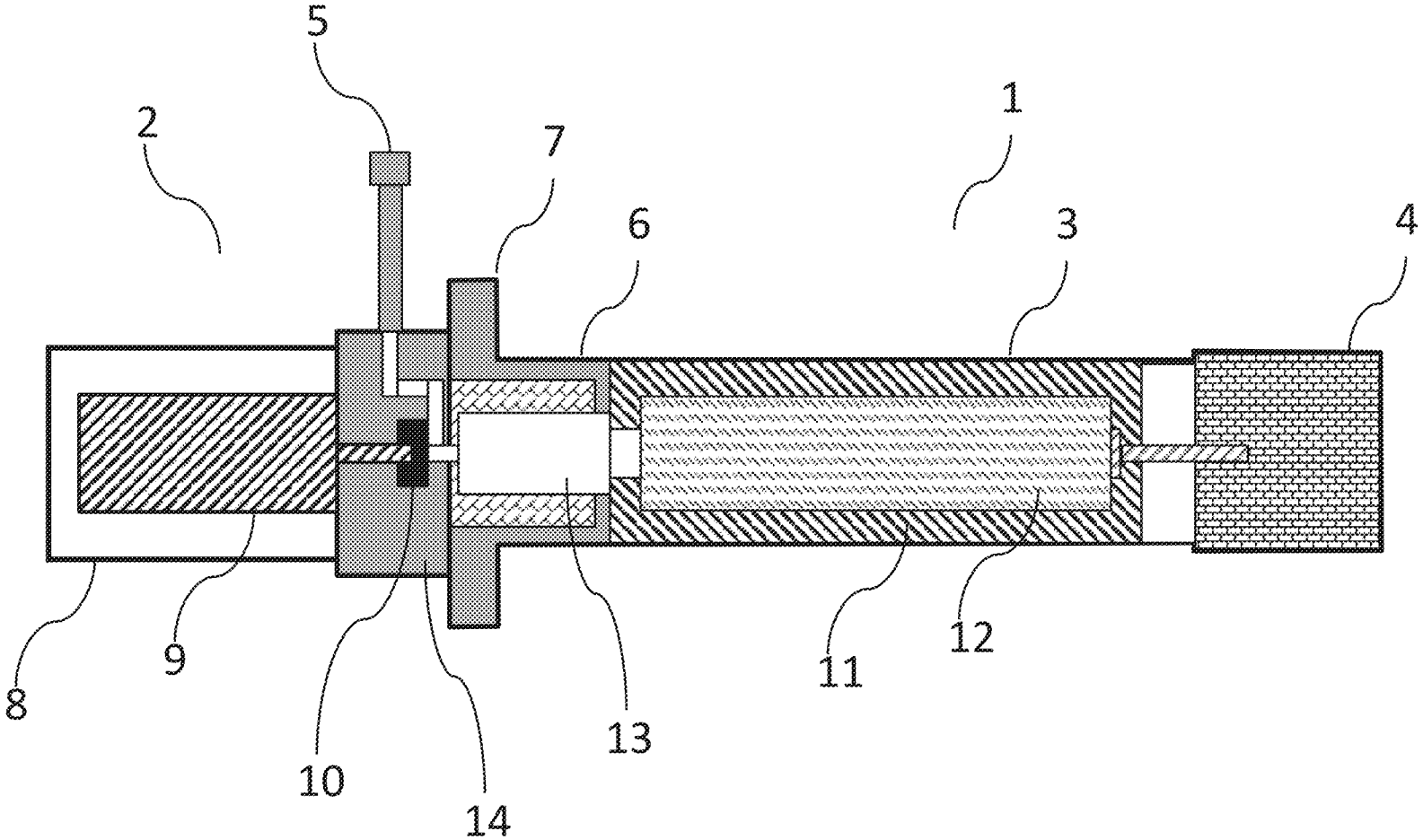
FIG. 1 depicts an embodiment of the cryocooler of the invention.

A conventional GM cryocooler uses an electric motor to actuate the rotary valve that controls the internal pressure. Such a cryocooler is prone to failure in a strong magnetic field because the electric motor is incapable of operating in such strong magnetic field environments. Electric motors may operate reliably in magnetic fields up to 500 Gauss (0.05 T), or even as high as 1,500 Gauss (0.15 T). Strong magnetic fields, that is those exceeding 1,500 (0.15 T) Gauss, render the electric motor inoperable and the cryocooler is unable to function.

The instant invention replaces the electric motor with a pneumatic motor to control and actuate the rotary valve. Additionally, the motor may itself be driven by diverting a portion of the source cryogenic gas, for example helium, from the compressor supplying the cryogenic gas to the GM cryocooler. Such a design therefore requires no additional subsystems to power the motor. Alternatively, the pneumatic fluid driving the pneumatic motor may be supplied from a separate source, such as another compressor. Using helium, whether from the same source as the cryogenic fluid or a separate source, also eliminates the risk of contaminating the GM's working fluid. For typical cryocoolers achieving very low temperatures, the working fluid is helium. A pneumatic motor allows the cryocooler to take advantage of short conductive paths when cooling high magnetic field components which can greatly reduce energy loss when compared to a convectively cooled system or a conductively cooled system with a long path length. This design therefore yields higher efficiency cooling schemes, translating into increased capabilities and weight and energy savings, particularly aboard Navy vessels.

The pneumatic cryocooler of the invention may be used to cryogenically cool a variety of devices, including superconducting magnets and other devices requiring cryogenic temperatures for operation. In some embodiments of the invention, the cryocooler is a GM cryocooler. In other embodiments, the invention contemplates other types of cryocoolers (e.g. pulse tube cryocoolers and others) which conventionally use electric motors but which may be adapted for operation in strong magnetic fields by employing a pneumatic motor as described herein. The invention employs a pneumatic motor operably attached to the cryocooler assembly.

The cryocooler device of the invention has several advantages, including reliable operation in high magnetic fields which have little to no effect on the pneumatic cryocooler, and the pneumatic cryocooler can be much closer to the field-producing components, allowing more efficient cooling schemes. Additionally, using a pneumatic motor eliminates the need for additional subcomponents such as power supplies which are required by electric motors.

With reference to the Figures, a pneumatic GM cryocooler of the invention is illustrated. The GM cryocooler is generally a tubular structure having a GM cryocooler assembly 1 and a motor assembly 2. The pneumatic GM cryocooler assembly has a displacer tube 3, and a heat exchanger 4 or "cold finger" on one end. The displacer tube is connected to the base tube 6 having attached thereto a base plate 7. At the cryocooler assembly's other end, a plurality of ports 5 are provided for the introduction of and removal of cryogenic fluid, which ports 5 are connected to high pressure 15 and low pressure 16 pressure cryogenic lines. A rotary valve 10 has four positions, two open respectively to the high and low pressure ports 5 feeding and removing cryogenic fluid from a compressor, and two closed positions alternately between the open positions. A pneumatic motor 9 within a motor cover 8 is mounted on the motor mount 14 which pneumatic motor is capable of actuating the rotary valve 10 to alternate between its several positions. In conventional GM cryocoolers, the motor is an electrical motor, run on electricity supplied thereto. In the pneumatic GM cryocooler of the invention, however, the motor 9 is a pneumatic motor 9 which needs no electricity. Instead, the pneumatic motor 9 generates mechanical motion (here, actuation of the rotary valve 10) via a supply of compressed fluid. Fluids include gases, such as air, helium, and other gases, as well as liquids, such as hydraulic fluid and others.

The GM cryocooling cycle can be divided generally into four steps as follows:

First, as shown in FIG. 1, the cycle starts when the rotary valve 10 is actuated by the pneumatic motor 9. In the first step in the cycle, the rotary valve 10 is actuated by the pneumatic motor 9 to the first position, open to high pressure room temperature cryogenic fluid fed from the high pressure cryogenic line 15. The fluid enters the GM cryocooler assembly through the stem 13, and fills the left side (as seen in the perspective of FIG. 1) of the displacer tube 3 forming a gas pocket.

Second, the rotary valve 10 is actuated by the pneumatic motor 9 into the second position, closed. The displacer 11 (in its right-most position from the end of the previous cycle) moves from right to left, forcing the gas to flow through the regenerator 12 to the right side, the cold end of the GM cryocooler assembly. The regenerator 12 maintains a warmer end to the left and a cooler end to the right as a result of previous cycles. During this part of the cycle, the gas passes from left to right through the regenerator 12 entering the regenerator 12 at ambient temperature and leaving it with a lower temperature due to its translocation through the regenerator 12. The heat storage feature of the regenerator 12 retains the temperature gradient between the warm and cold ends of the GM cryocooler assembly 1 and smooths out the cyclic temperature variation of the gas.

Third, the rotary valve 10 is actuated by the pneumatic motor 9 into its third position, open to the low pressure cryogenic line 16 under suction from the compressor, causing the gas in the right side of the displacer tube 3 to expand and thereby cooling the gas. The heat exchanger 4 at the right end of the GM cryocooler assembly 1 is thereby cooled.

Fourth, in the final portion of the cycle, the rotary valve 10 is actuated by the pneumatic motor 9 into its fourth position, the displacer 11 moves to the right to reposition the gas pocket to the warmer end of the displacer tube 3 to ready it for the beginning of the next cycle, the high pressure gas filling phase. During this part of the cycle, the gas passes through the regenerator 12 from right to left, and the heat storage feature of the regenerator 12 smooths out the cyclic temperature of the gas as it flows between the two ends of the regenerator.

In many GM cryocoolers, the displacer movement is controlled via mechanical means. Pneumatic means of displacer control are also available, offering improved efficiency and reducing wear and tear from mechanical vibration. See, for example, U.S. Pat. No. 3,620,029. Even in such current GM cryocoolers using pneumatic means for the displacer, however, the motor controlling the rotary valve in state of the art cryocoolers is an electric mechanical motor.

The invention replaces the electric motor with a pneumatic motor 9, and is amenable to the use of a variety of pneumatic fluids, such as air, helium, and others. When air is used, a separate air compressor component is used to deliver the driving force to the pneumatic motor, which then controls actuation of the rotary valve. Likewise, pneumatic motors using hydraulic fluid are appropriately used in the invention, in which case a separate compressor for hydraulic fluid is used to deliver the pneumatic motor fluid to the pneumatic motor 9.

Cooling power, generally measured in watts, represents the quantity of heat a particular crycooler, paired with a particular compressor, is capable of removing in reaching a particular temperature at the heat exchanger cold finger. In embodiments which rely on separate compressors providing pneumatic fluid to drive the pneumatic motor (at the same RPM as the stock electric motor), the crycooler/compressor system's cooling power will be largely unaffected as no changes have been introduced to the crycooler paired with its compressor. The RPM may be adjusted with a pneumatic motor (just as it may be with an electric motor), to produce different cooling powers for different target temperatures.

Figure 2:
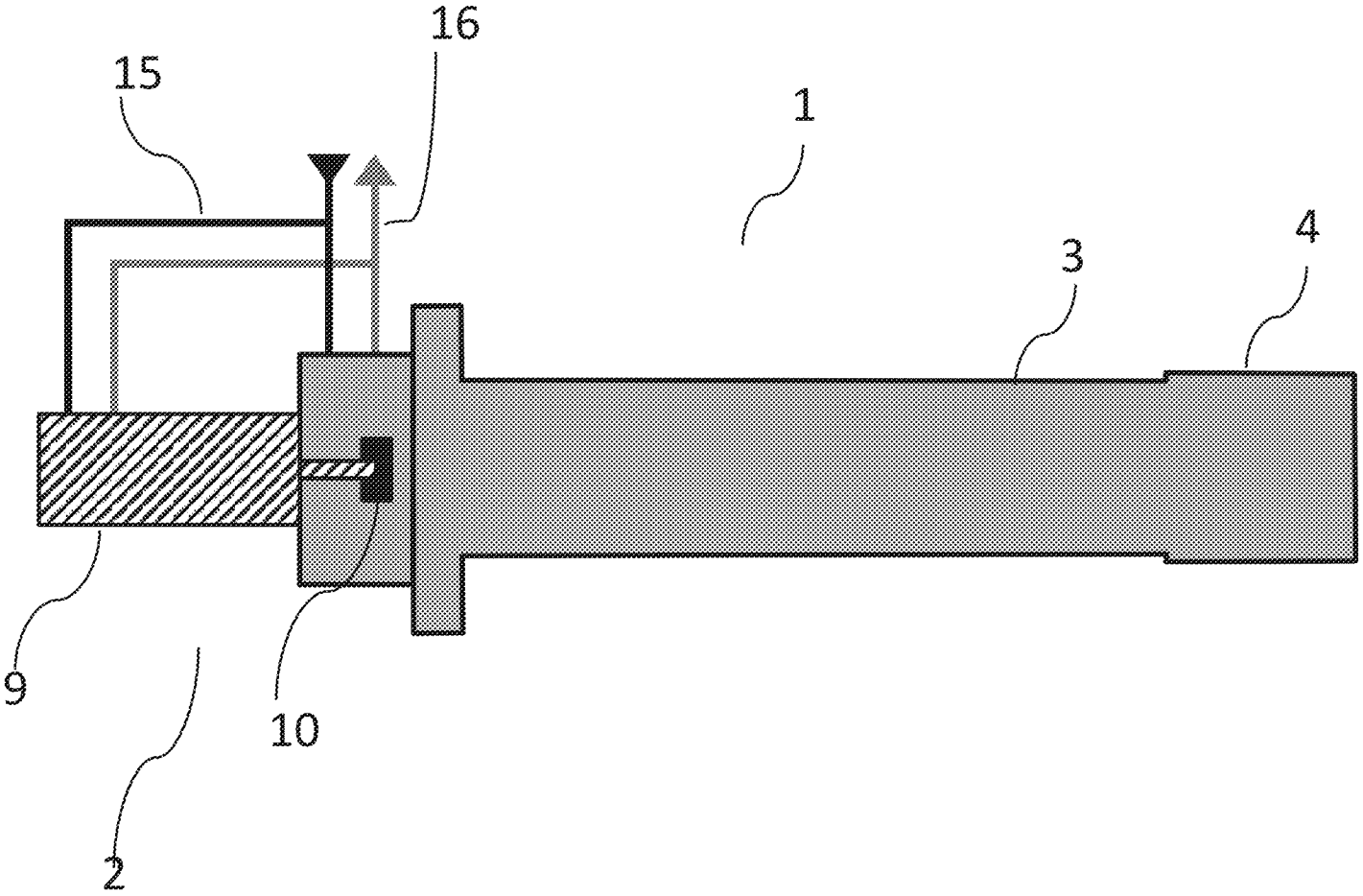
FIG. 2 depicts an embodiment of the cryocooler of the invention.

More preferably, the invention uses helium as the pneumatic motor's fluid. While a separate compressor for delivering the helium may be used, those of skill in the art will appreciate that because the cryogenic fluid being used in the cryocooler itself and the pneumatic motor fluid are both helium, one may use the same helium source as that of the helium cryogenic fluid. In such an embodiment, the helium used for the pneumatic motor may be derived via diversions from the high 15 and low 16 pressure lines conducting the helium to and from the GM cryocooler assembly and compressor, as depicted in FIG. 2. Alternatively, the compressor may be equipped with separate high and low pressure ports for delivering helium to and from the pneumatic motor at different pressures than that delivered and removed from the GM cryocooler assembly.

In such embodiments in which the pneumatic motor is driven from the same source helium as that which is used in the cryocooler assembly, the cooling power of the cryocooler will be reduced because some of its working fluid is being diverted to drive the pneumatic motor. Depending on the particular application for the cryocooler, such reduced cooling power may still fall well within the operating requirements for the application. Should one require more cooling power, larger or more powerful compressors paired with the same cryocooler will typically have greater cooling power. Those of skill in the art will appreciate that in embodiments of the invention which drive the pneumatic motor by drawing the helium from the same source as the cryocooler system, one would choose a compressor capable of providing the system with sufficient cooling power for the particular application.

EXAMPLES

The following Examples serve to illustrate the present invention and are not intended to limit its scope in any way.

Example 1—a Pneumatic Motor Controlled Cryocooler, Using Helium

A cryocooler with a pneumatic motor using helium as the pneumatic fluid is constructed as follows.

A Cryomech AL325 GM cryocooler specifies a 0.05 T (500 Gauss) magnetic field limit due to its electric motor's susceptibility to failure at stronger magnetic fields. The magnetic field in close proximity to a superconducting magnet may be 1 T or higher, therefore the AL325's electric motor will not function properly in the environment, resulting in the reduction or complete loss of cooling power. Depending on how low the performance drops, such a GM cryocooler may not be able to provide sufficient cooling power to keep the superconducting magnet below the critical temperature, which could result in the superconducting magnet transitioning from electrically superconducting to electrically normal conducting, which could damage the superconducting magnet.

The stock AC synchronous electric motor in the AL325 is encased in an aluminum cylinder and is press fit and bolted to the motor mount end of the GM cryocooler assembly. This electric motor was removed, and replaced with a pneumatic motor mounted in its place. No additional subsystems are needed to power the pneumatic motor. There are commercial pneumatic motors that meet the speed and torque performance of the electric motor they replace. The pneumatic motor was supplied with helium from the same compressor providing helium to the GM cooler assembly at an appropriate pressure to produce the desired speed and torque for actuating the rotary valve. Those of skill in the art will appreciate that the flow of helium to the pneumatic motor may be supplied at the same or different pressures than that supplying the cryocooler assembly with appropriate regulator mechanisms. Additionally, unlike using a hydraulic motor, by using helium, the same cryogenic fluid as the cryocooler, the risk of contaminating the GM cryocooler's working cryogenic fluid, helium, is eliminated. Due to the compressibility of helium, care must be taken in controlling the pressure and flow rate which control the speed and torque of the motor.

A stock Cryomech AL325 GM cryocooler using a synchronous electric motor at 60 RPM and its stock compressor has cooling power of 142.6 W for a temperature of 30K at the cold finger. Such a stock Cryomech AL325 GM cryocooler was tested for cryogenic cooling capacity of a superconducting magnet in increasing magnetic field strengths. The electric motor failed when the magnetic field reached 0.15 Tesla (1,500 Gauss).

A pair of the same stock GM cryocoolers were modified according to the invention with pneumatic motors driven by helium drawn from the system, and were tested for cryogenic cooling capacity at various temperatures. The modified GM cryocoolers produced cooling power measured at 117.2 W for a temperature of 30K at the cold finger at 60 RPM, a 17% reduction in cooling capacity from the stock cooling power. This was expected, of course, because some of the cryocooler's working gas, helium, was being diverted to power the pneumatic motor. For cryocooling applications requiring cooling power in this range, the modified pneumatic cryocooler is operationally sufficient. However, if more cooling power is required, a larger compressor may be used to provide more power to the complete system. The pneumatic cryocoolers as described above were paired with larger compressors, and the resulting data showed the pneumatic GM cryocoolers with larger compressors each measured a cooling power of 130 W for a temperature of 30K at the cold finger, only a 9% reduction in cooling power from the stock AL325. It was then determined that adjusting the pneumatic motor to generate 50 RPM further improved the cooling power to 135 W, a mere 5% reduction from the stock AL325. Additional modifications to the compressor size and the RPM of the pneumatic motor may be made to achieve higher cooling powers, if desired.

Unlike the stock AL325 with electric motor, which failed at 0.15 Tesla, the pneumatic cryocoolers as described in this Example proved to be capable of operation in the strong magnetic field of 1.05 Tesla (10,500 Gauss), thereby being capable of cryogenically cooling the superconducting magnets when in close proximity thereto.

Example 2—a Pneumatic Motor Controlled Cryocooler, Using Air

A cryocooler with a pneumatic motor as in Example 1 is constructed, but using air as the pneumatic medium instead. Similar to Example 1, the pneumatic motor is supplied with air to produce the desired speed and torque for actuating the rotary valve. The air-driven pneumatic motor uses a separate air compressor, with associated plumbing and hardware to supply the pneumatic motor the appropriate pressure.

Those of skill in the art will appreciate that care must be taken to eliminate or reduce the risk that air may contaminate the GM cryocooler's working cryogenic fluid, helium.

Example 3—a Pneumatic Motor Controlled Cryocooler, Using Hydraulic Fluid

A cryocooler with a pneumatic motor as in Example 1 is constructed, but using a hydraulic fluid to drive the pneumatic motor. Similar to Example 1 and Example 2, the hydraulic motor is supplied with hydraulic fluid, mainly an incompressible fluid such as oil, to produce the desired speed and torque for actuating the rotary valve. The hydraulic motor requires a separate hydraulic fluid pump, and associated plumbing and hardware to supply the hydraulic motor the appropriate pressure. Those of skill in the art will appreciate that care must be taken to eliminate or reduce the risk that hydraulic fluid may contaminate the GM cryocooler's working cryogenic fluid, helium.

The present invention is not to be limited in scope by the specific embodiments described above, which are intended as illustrations of aspects of the invention. Functionally equivalent methods and components are within the scope of the invention. Various modifications of the invention, in addition to those shown and described herein, will be readily apparent to those skilled in the art from the foregoing description. Such modifications are intended to fall within the scope of the appended claims. All cited documents are incorporated herein by reference.

What is claimed is:

1. A pneumatic cryocooler capable of operation in a strong magnetic field, comprising:

a cryocooler assembly having a first end and a second end, the first end comprising a rotary valve, a plurality of ports for a cryogenic fluid, and a motor mount;

the second end comprising a heat exchanger; and a pneumatic motor assembly comprising a pneumatic motor, the pneumatic motor assembly operably connected to the motor mount on the first end of the cryocooler assembly;

wherein the cryocooler assembly is a GM cryocooler assembly, the plurality of ports carrying cryogenic fluid supplies the cryocooler assembly with the cryogenic fluid, and the plurality of ports comprise separate ports for the cryogenic fluid and a pneumatic fluid, and the pneumatic fluid being directed to the pneumatic motor.

2. The pneumatic cryocooler of claim 1, wherein the GM cryocooler assembly further comprises a base tube and a displacer tube, the displacer tube having situate within a displacer and a regenerator.

3. The pneumatic cryocooler of claim 1, wherein the cryogenic fluid and the pneumatic fluid are the same compound.

4. The pneumatic cryocooler of claim 3, wherein the pneumatic fluid and the cryogenic fluid are helium.

5. The pneumatic cryocooler of claim 1, wherein the pneumatic fluid is helium.

6. The pneumatic cryocooler of claim 1, wherein the pneumatic fluid is air.

7. A method of cryogenically cooling a device, the method comprising the step of applying to the device the heat exchanger of the pneumatic cryocooler of claim 1.

8. The method of claim 7 wherein the device is a superconducting magnet.

9. The method of claim 7 wherein the device is located in a strong magnetic field.

10. A hydraulic cryocooler capable of operation in a strong magnetic field, comprising:

a cryocooler assembly having a first end and a second end, the first end comprising a rotary valve, a plurality of ports for a cryogenic fluid, and a motor mount;

the second end comprising a heat exchanger; and a hydraulic motor assembly comprising a hydraulic motor, the hydraulic motor assembly operably connected to the motor mount on the first end of the cryocooler assembly;

wherein the cryocooler assembly is a GM cryocooler assembly, the plurality of ports carrying cryogenic fluid supplies the cryocooler assembly with the cryogenic fluid, and wherein the plurality of ports comprise separate ports for the cryogenic fluid and a hydraulic fluid, and the hydraulic fluid being directed to the hydraulic motor.

11. The hydraulic cryocooler of claim 10, wherein the GM cryocooler assembly further comprises a base tube and a displacer tube, the displacer tube having situate within a displacer and a regenerator.

12. A method of cryogenically cooling a device, the method comprising the step of applying to the device the heat exchanger of the pneumatic cryocooler of claim 10.

13. The method of claim 12 wherein the device is a superconducting magnet.

14. The method of claim 12 wherein the device is located in a strong magnetic field.

* * * * *